US005990781A

United States Patent [19]

Kambara

[11] Patent Number: 5,990,781

[45] Date of Patent: Nov. 23, 1999

[54] CHIP TYPE RESISTOR AND MANUFACTURING METHOD THEREOF

[75] Inventor: Shigeru Kambara, Kyoto, Japan

[73] Assignee: Rohm Co., Ltd., Kyoto, Japan

[21] Appl. No.: 09/041,700

[22] Filed: Mar. 13, 1998

[30] Foreign Application Priority Data

Mar. 18, 1997 [JP] Japan ..... 9-064836

[51] Int. Cl.[6] ..... H01C 1/012

[52] U.S. Cl. ..... 338/309; 338/331; 338/332

[58] Field of Search ..... 338/307, 308, 338/309, 325, 322, 327, 323, 313, 331, 332

[56] References Cited

U.S. PATENT DOCUMENTS 5,446,437 8/1995 Bantien et al. ..... 338/25

FOREIGN PATENT DOCUMENTS 60-27104 2/1985 Japan .
3-187259 7/1991 Japan .
3-215901 9/1991 Japan .
4-102302 4/1992 Japan .

*Primary Examiner*—Michael L. Gellner
*Assistant Examiner*—Richard K. Lee
*Attorney, Agent, or Firm*—Nikaido Marmelstein Murray & Oram LLP

[57] ABSTRACT

A chip type resistor includes terminal electrodes having main upper electrodes, extensions or enclaves of a resistive film formed on left and right sides of the upper surface of main upper electrodes, and auxiliary upper electrodes formed on upper surfaces of extensions or enclaves. Therefore, step between the upper surface of terminal electrodes at opposing ends of resistive film and an upper surface of cover coat covering the resistive film can be reduced or eliminated at a low cost.

4 Claims, 10 Drawing Sheets

CHIP TYPE RESISTOR AND MANUFACTURING METHOD THEREOF

BACKGROUND OF THE INVENTION

1. Field of the Invention

The present invention relates to a structure and manufacturing method of a chip type resistor having a resistive film and terminal electrodes positioned at opposing ends of the resistive film, formed on a chip type insulating substrate.

2. Description of the Background Art

In a conventional chip type resistor such as described in Japanese Patent Laying-Open No. 60-27104, an upper surface of a cover coat covering a resistive film formed on an upper surface of a chip type insulating substrate is protruded from a surface of terminal electrodes positioned at opposing ends of the resistive film, so that there is a considerable step between the upper surface of the cover coat and the upper surface of the terminal electrodes. Therefore, it often suffers from the problem that when the chip type resistor is soldered on a printed board with the side of the resistive film facing the printed board, one side of the chip type resistor rises or floats, preventing secure soldering of terminal electrodes at the opposing ends.

In view of the foregoing, Japanese Patent Laying-Open No. 4-102302 discloses a structure of a chip type resistor in which terminal electrodes 3 are formed at opposing ends of a resistive film 2 on left and right end portions of a chip type insulating substrate 1 such that the terminal electrodes 3 each includes a main upper electrode 3*a* formed on the surface of insulating substrate 1 and conductive to resistive film 2, an auxiliary upper electrode 3*b* formed heaped up on the surface of main upper electrode 3*a,* a side electrode 3*c* formed on either side of insulating substrate 1, and a metal plate layer 3*d* formed over the surfaces of auxiliary upper electrode 3*b* and side electrode 3*c,* as shown in FIGS. 28 and 29. This laid-open patent application proposes, by this structure, to reduce or eliminate the step between the upper surface of terminal electrode 3 and the upper surface of cover coat 4 using auxiliary upper electrode 3*b*.

Cover coat 4 has a three-layered structure including an undercoat 4*a* directly covering resistive film 2, a middle coat 4*b* covering undercoat 4*a,* and an overcoat covering middle coat 4*b,* or a two-layered structure with under coat 4*a* or middle coat 4*b* omitted.

The chip type resistor disclosed in Japanese Patent Laying-Open No. 4-102302 is manufactured through the following steps.

Step 1. On an upper surface of the insulating substrate 1, main upper electrodes 3*a* are formed and thereafter resistive film 2 is formed. Alternatively, resistive film 2 is formed first and thereafter main upper electrodes 3*a* are formed.

Step 2. Undercoat 4*a* of glass is formed on resistive film 2. Thereafter, resistive film 2 and undercoat 4*a* are engraved to form a trimming groove by laser beam irradiation, for example, while resistance value of resistive film 2 is measured by a conductive probe which is brought into contact with main upper electrodes 3*a* so that the resistance value of resistive film 2 is within a prescribed tolerable range.

Step 3. Middle coat 4*b* of glass is formed on the surface of undercoat 4*a* to fill the trimming groove. Thereafter, overcoat 4*c* of glass or a synthetic resin is formed covering resistive film 2, part of the main upper electrodes 3*a*, undercoat 4*a* and middle coat 4*b*.

Step 4. On the upper surface of main upper electrodes 3*a*, auxiliary upper electrodes 3*b* are formed. Thereafter, side electrodes 3*c* are formed on end surfaces of insulating substrate 1, and surfaces of auxiliary upper electrodes 3*b* and side electrodes 3*c* are subjected to metal plating, whereby a metal plate layer 3*d* is formed.

In the above described chip type resistor, auxiliary electrodes 3*b* are formed on the upper surfaces of the main upper electrodes 3*a* by directly applying the conductive paste by screen printing. Therefore, in order to reduce or eliminate the step between upper surfaces of terminal electrodes 3 and cover coat 4, auxiliary electrodes 3*b* must be made thick.

In order to increase thickness of auxiliary upper electrode 3*b*, the number of application of the conductive paste for the auxiliary upper electrodes 3*b* must be increased. Therefore, amount of conductive paste used is increased, resulting in considerable increase in manufacturing cost of the chip type resistor.

SUMMARY OF THE INVENTION

An object of the present invention is to provide a chip type resistor having such a structure that can perfectly prevent rising or floating of one side of the resistor when the resistor is mounted by soldering to a printed board.

Another object of the present invention is to provide a method of manufacturing the chip type resistor attaining the above described object, which suppresses increase in cost of the chip type resistor by reducing amount of material used for the chip type resistor.

The above described objects of the present invention can be attained by the chip type resistor in accordance with one aspect of the present invention having terminal electrodes positioned at opposing ends of a resistive film formed at left and right end portions of an insulating substrate, the terminal electrodes each including at least a main upper electrode formed on an upper surface of the insulating substrate and conductive to the resistive film, and an auxiliary upper electrode formed on an upper surface of the main upper electrode, the chip type resistor further having a cover coat covering the resistive film, formed on the upper surface of the insulating substrate, wherein said resistive film has extensions or enclaves (isolated patches) formed on left and right sides of the upper surface of the main upper electrode, and the auxiliary upper electrodes are formed on an upper surface of the extensions or enclaves.

Preferably, the auxiliary upper electrode is provided between the extensions or between the enclaves of the resistive film on the upper surface of the main upper electrode.

Preferably, the main upper electrode is formed with left and right sides superposed on the extensions or enclaves of the resistive film, and the auxiliary upper electrode is formed on that portion of the upper surface of the main upper electrode which is superposed on the extension or enclave, or which is between the overlapping portions.

The above described objects of the present invention is attained by the method of manufacturing a chip type resistor in accordance with the present invention including the steps of: forming a pair of left and right main upper electrodes on an upper surface of an insulating substrate; forming a resistive film having opposing ends conductive to said main upper electrodes such that extensions or enclaves of the resistive film are provided on left and right sides of the upper surface of said main upper electrodes; forming a cover coat covering the resistive film; and forming auxiliary upper electrodes on upper surfaces of the extensions or enclaves of the resistive film or on portions of the upper surfaces of the main upper electrodes which are between the extensions of enclaves.

As described above, extensions or enclaves of the resistive film are formed on both left and right sides on the upper surface of the main upper electrode and auxiliary upper electrodes are formed on upper surfaces of the extensions or enclaves. Therefore, the left and right terminal electrodes come to have a three-layered structure including the main upper electrode, the extension or enclave of the resistive film and the auxiliary upper electrode. Therefore, the height from the upper surface of the insulating substrate to the upper surface of the auxiliary upper electrode includes thickness of the conventional auxiliary upper electrode and of the main upper electrode plus the thickness of the resistive film. As a result, the thickness of the auxiliary upper electrode can be made thinner by the thickness of the resistive film as compared with the prior art.

Since extensions or enclaves of the resistive film are formed on both left and right sides on the upper surface of the main upper electrode and the auxiliary upper electrode is formed between the extensions or enclaves on the upper surface of the main upper electrode, when the auxiliary upper electrode is formed by applying a conductive paste by screen printing or the like, the extensions or enclaves positioned on the left and right sides block flow of the conductive paste applied to the portion therebetween in the widthwise direction of the insulating substrate. As a result, the conductive paste in small amount can be heaped up high.

Here, when the extensions or enclaves of the resistive film are formed both on the left and right sides on the upper surface of the main upper electrode, it is possible when the resistive film is adjusted by trimming while measuring resistance value thereof, to bring a conductive probe directly into contact with each of the main upper electrodes. Therefore, exact trimming adjustment of the resistive film is possible.

According to the present invention, the amount of conductive paste used for forming the auxiliary upper electrodes can be reduced and the number of application of the conductive paste by screen printing can be reduced, without sacrificing exactness of trimming adjustment, whereby manufacturing cost can significantly be reduced.

Further, such function and effects can also be attained by a structure in which extensions or enclaves of the resistive film are formed superposed on both left and right sides on the upper surface of the main upper electrode and the auxiliary upper electrode is formed between the extensions or enclaves of the resistive film on the upper surface of the main upper electrode, or a structure in which the main upper electrode is formed with left and right sides superposed on extensions or enclaves of the resistive film, and an auxiliary upper electrode is formed on that portion of the upper surface of the main upper electrode which is superposed on the extension or enclave of the resistive film.

Particularly, according to the manufacturing method of the present invention, the extensions or enclaves of the resistive film are formed simultaneously with the resistive film, and therefore the number of process steps is not increased to form the extensions or enclaves.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described with reference to the figures.

(First Embodiment)

FIGS. 1 to 19 show the first embodiment.

The chip type resistor in accordance with the first embodiment is manufactured through the following method.

Step 1. First, referring to FIG. 1, a pair of left and right main upper electrodes 13*a* are formed on an upper surface of a chip type insulating substrate 11, by applying a row material conductive paste by screen printing, followed by sintering.

Step 2. Thereafter, referring to FIGS. 2 to 5, on the upper surface of insulating substrate 11, a resistive film 12 is formed by application of a raw material paste by screen printing, followed by sintering. At this time, simultaneously with the formation of resistive film 12, extensions 12' integrally extending from resistive film 12 are formed superposed on both left and right sides on the upper surface of main upper electrodes 13*a*.

Step 3. On the upper surface of insulating substrate 11, referring to FIGS. 6 and 7, an undercoat 14*a* of glass covering resistive film 12 is formed by application by screen printing of a raw material, followed by sintering. Thereafter, resistive film 12 and undercoat 14*a* are engraved to form a trimming groove 12*a* by laser beam irradiation, for example, while resistance value of resistive film 12 is measured by a conductive probe (not shown) brought into contact with that portion of the upper surface of main upper electrodes 13*a* which is between the extension 12' so that the resistance value of resistive film 12 is within a prescribed tolerable range, whereby trimming adjustment is realized.

Figure 1:
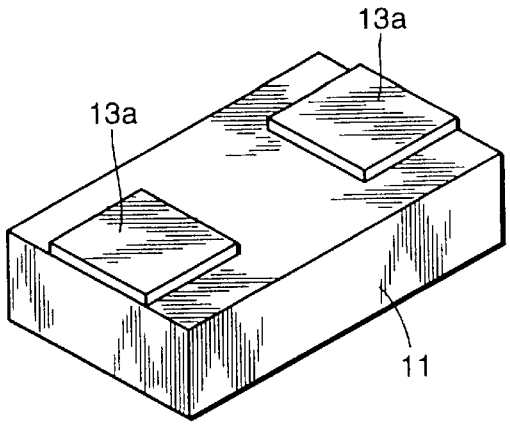
FIG. 1 is a perspective view showing main upper electrodes formed on an insulating substrate in accordance with a first embodiment.
Figure 2:
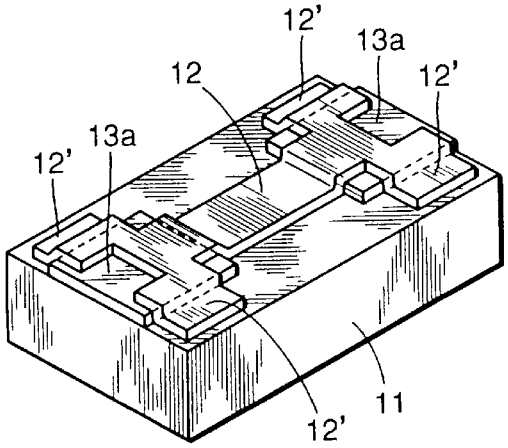
FIG. 2 is a perspective view showing a resistive film formed on the insulating substrate in accordance with the first embodiment.
Figure 3:
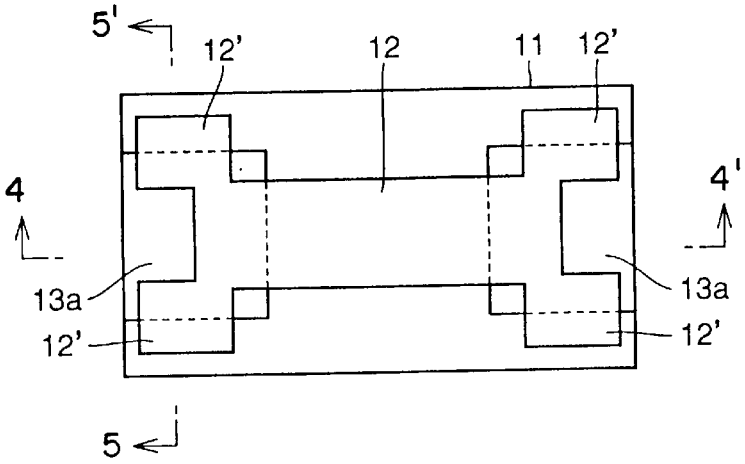
FIG. 3 is a plan view of FIG. 2.
Figure 4:
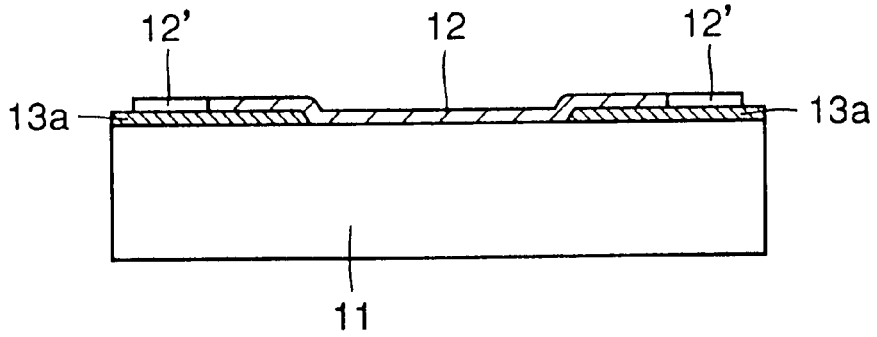
FIG. 4 is a cross section taken along the line 4-4' of FIG. 3.
Figure 5:
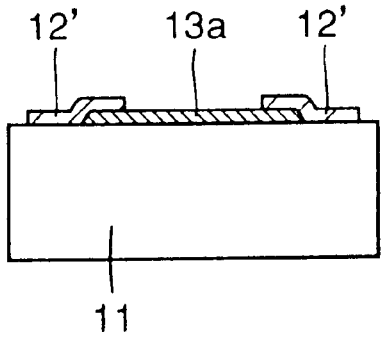
FIG. 5 is a cross section taken along the line 5-5' of FIG. 3.
Figure 6:
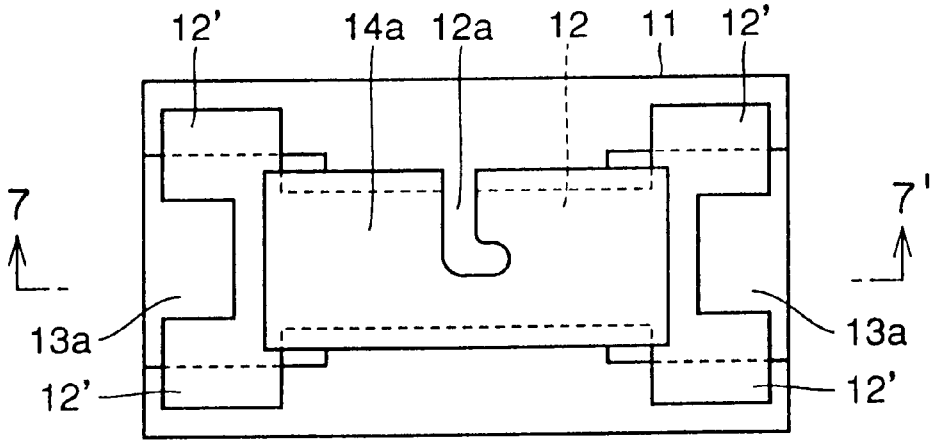
FIG. 6 is a plan view showing a state in which an undercoat is formed on the insulating substrate in accordance with the first embodiment.
Figure 7:
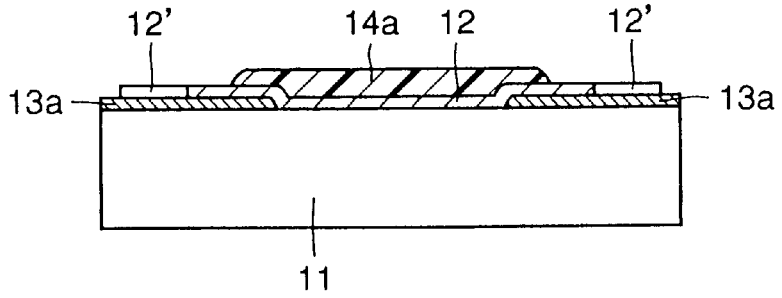
FIG. 7 is a cross section taken along the line 7-7' of FIG. 6.
Figure 8:
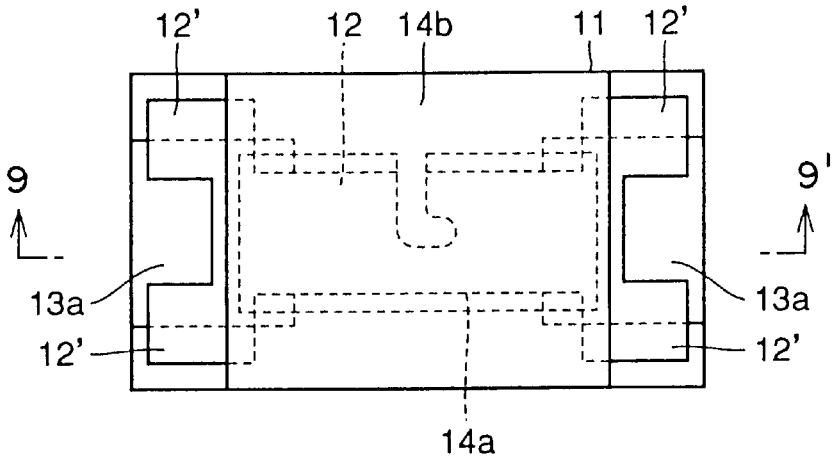
FIG. 8 is a plan view showing a state in which a middle coat is formed on the insulating substrate in accordance with the first embodiment.
Figure 9:
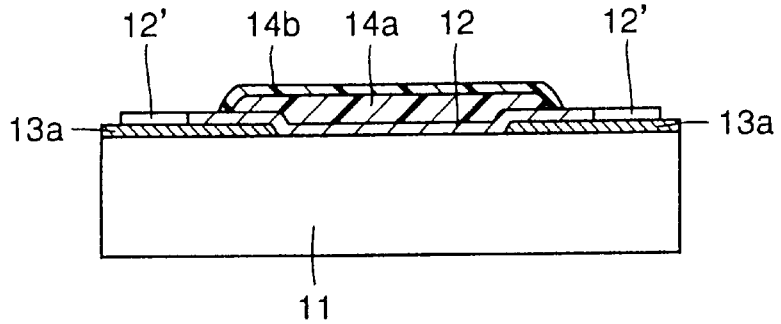
FIG. 9 is a cross section taken along the line 9-9' of FIG. 8.

Step 4. Referring to FIGS. 8 and 9, a middle coat 14*b* of glass to fill trimming groove 12*b* is formed on the upper surface of insulating substrate 11, by application of a raw material by screen printing, followed by sintering.

Figure 10:
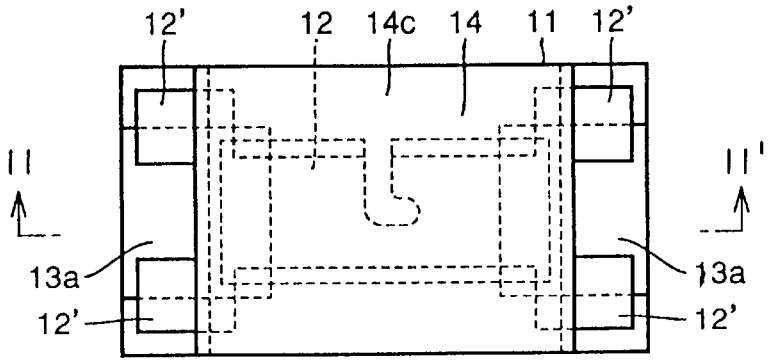
FIG. 10 is a plan view showing a state in which an overcoat is formed on the insulating substrate in accordance with the first embodiment.
Figure 11:
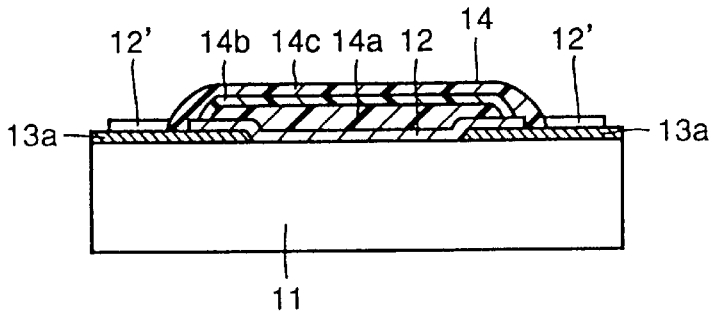
FIG. 11 is a cross section taken along the line 11-11' of FIG. 10.

Step 5. Referring to FIGS. 10 and 11, an overcoat 14*c* entirely covering middle coat 14*b* is formed on the upper surface of insulating substrate 11 by application of a raw material by screen printing, followed by sintering. In this manner, cover coat 14 having a three layered structure including undercoat 14*a*, middle coat 14*b* and overcoat 14*c* is formed.

Figure 12:
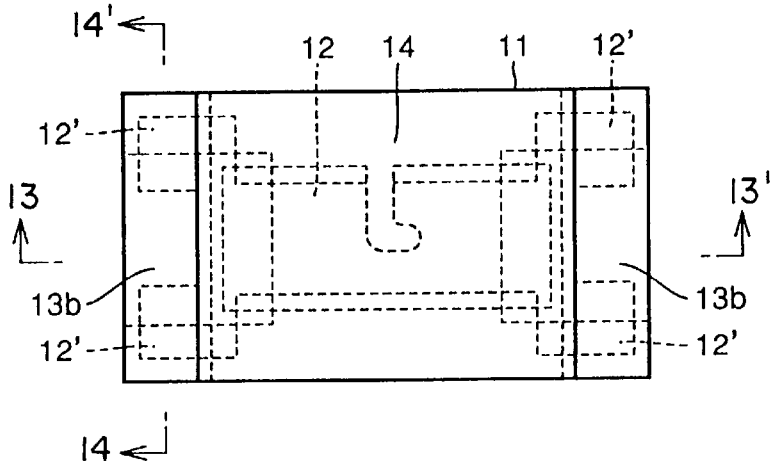
FIG. 12 is a plan view showing a state in which an auxiliary upper electrode is formed on the insulating substrate in accordance with the first embodiment.
Figure 13:
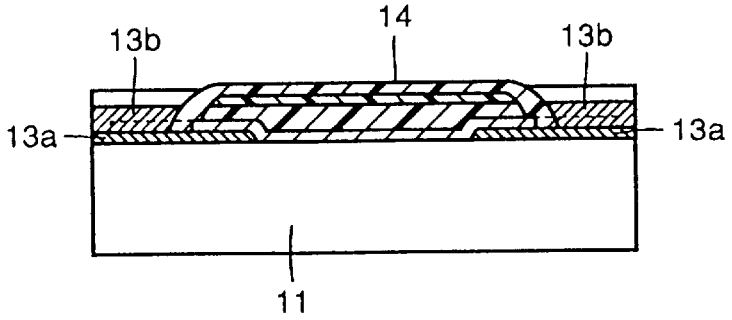
FIG. 13 is a cross section taken along the line 13-13' of FIG. 12.
Figure 14:
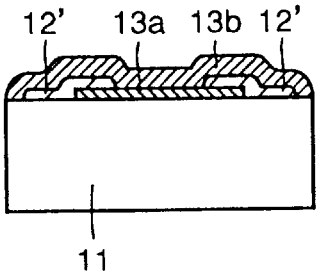
FIG. 14 is a cross section taken along the line 14-14' of FIG. 12.

Step 6. Referring to FIGS. 12 to 14, an auxiliary upper electrode 13*b* is formed on the upper surface of main upper electrode 13*a* such that the auxiliary upper electrode is superposed over both the extensions 12' of resistive film 12 and the upper surface of main upper electrode 13*a*, by application of a raw material conductive paste by screen printing, followed by sintering.

Figure 15:
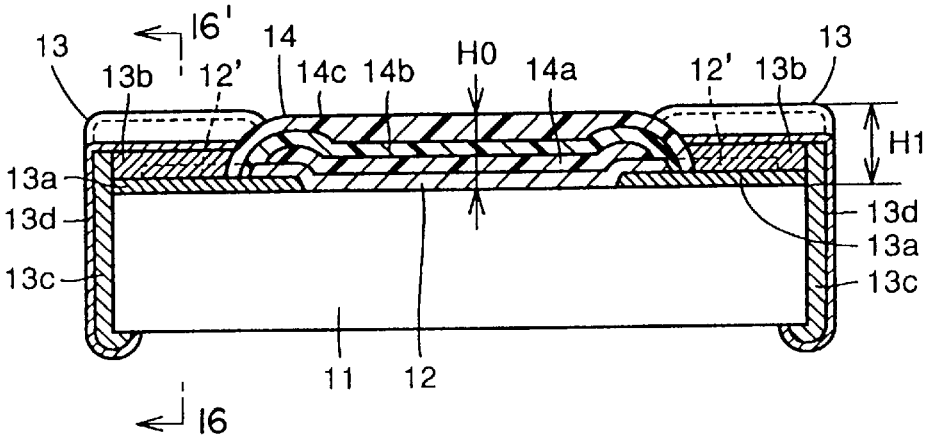
FIG. 15 is a vertical cross section showing the chip type resistor in accordance with the first embodiment.
Figure 16:
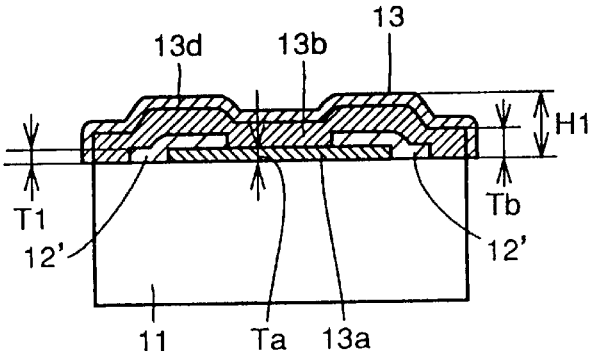
FIG. 16 is a cross section taken along the line 15-15' of FIG. 15.

Step 7. Referring to FIGS. 15 and 16, side electrodes 13*c* are formed on left and right surfaces of insulating substrate 11 by application of a raw material conductive paste and sintering, and thereafter metal plating is performed entirely, so as to form metal plate layers 13*d* on auxiliary upper electrodes 13*b* and on side electrodes 13*c*, and thus terminal electrodes 13 are completed.

In the chip type resistor manufactured in this manner, the portion of terminal electrode 13 on the upper surface of insulating substrate 11 has a three layered structure as shown in FIGS. 15 and 16. More specifically, terminal electrode 13 has a main upper electrode 13*a*, an extension 12' of resistive film 12 on left and right sides of the upper surface of main upper electrode, and auxiliary upper electrode 13*b* formed on the upper surface of extension 12'. The height H1 from the upper surface of insulating substrate 11 to the upper surface of auxiliary upper electrode 13*b* (more exactly, height between the upper surface of insulating substrate 11 to the upper surface of metal plate layer 13*c*) corresponds to the thickness Tb of auxiliary upper electrode 13*b*, thickness Ta of main upper electrode 13*a* plus thickness T1 of resistive film 12, when the height H1 is made exactly or approximately the same as the height H0 from the upper surface of insulating substrate 11 to the upper surface of overcoat 14*c*. Therefore, the thickness Tb of auxiliary upper electrode 13*b* can be made thinner by the thickness T1 of resistive film 12 as compared with the prior art.

Figure 17:
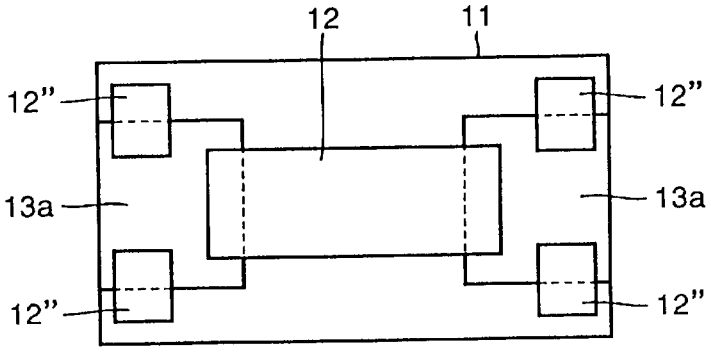
FIG. 17 is a plan view showing a modification of the first embodiment.
Figure 18:
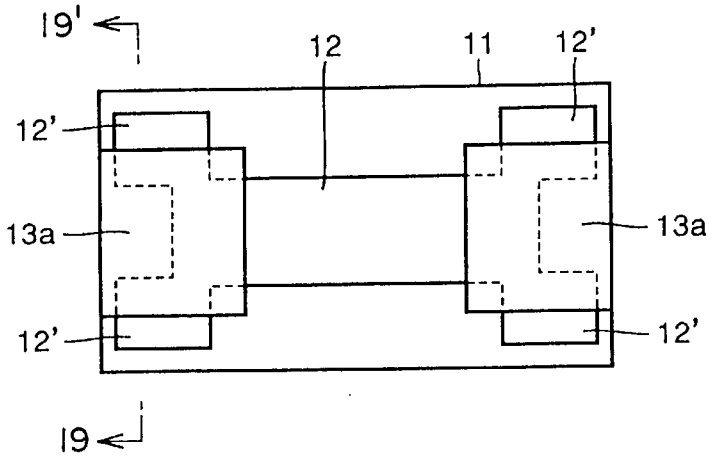
FIG. 18 is a plan view showing another modification of the first embodiment.
Figure 19:
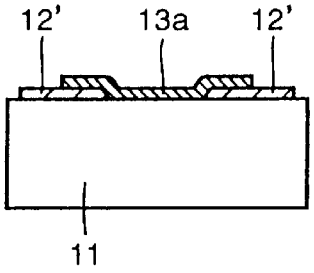
FIG. 19 is a cross section taken along the line 18-18' of FIG. 18.

The extension 12' of resistive film 12 may, alternatively, be formed as an enclave 12" separate from resistive film 12 as shown in FIG. 17. Alternatively, the extension may have a shape appropriately combining extension 12' and enclave 12". For example, the extension 12' may be formed on one of the main upper electrodes 13*a* and an enclave 12" may be formed on the other one of the main upper electrodes.

In the first embodiment described above, main upper electrodes 13*a* are formed, thereafter resistive film 12 is formed with extensions 12' or enclaves 12" superposed on left and right sides of main upper electrodes 13*a*, and thereafter auxiliary upper electrodes 13*b* are formed superposed on extensions 12' or enclaves 2" of resistive film 12. Alternatively, referring to FIGS. 18 and 19, resistive film 12 together with extensions 12' or enclaves 2" may be formed first, thereafter main upper electrodes 13*a* may be formed with the left and right sides superposed on the extensions 12' or enclaves 12" of resistive film 12 and, thereafter, auxiliary upper electrodes 13*b* may be formed on portions of the upper surface of the main upper electrodes 13*a* which are on the extensions 12' or enclaves 12" of resistive film 12 (other structures are the same).

(Second Embodiment)

FIGS. 20 to 24 show a second embodiment.

The second embodiment is similar to the first embodiment until formation of overcoat 14*c*. The present embodiment differs from the first embodiment in subsequent formation of auxiliary upper electrodes 13*b*.

Figure 20:
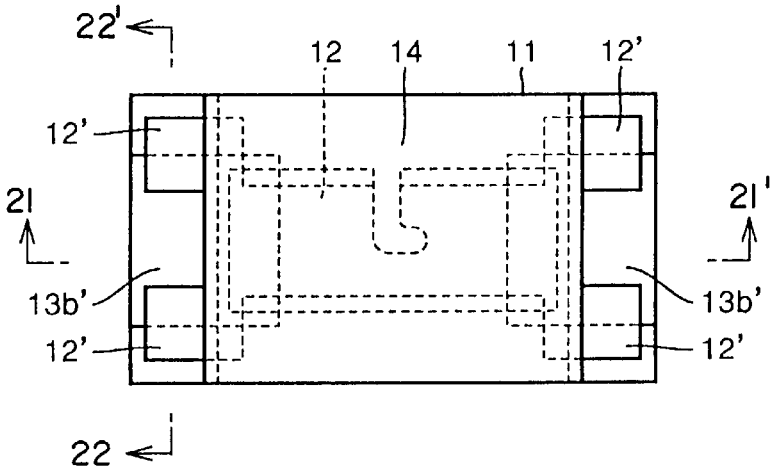
FIG. 20 is a plan view showing a state in which an auxiliary upper electrode is formed on the insulating substrate in a second embodiment.
Figure 21:
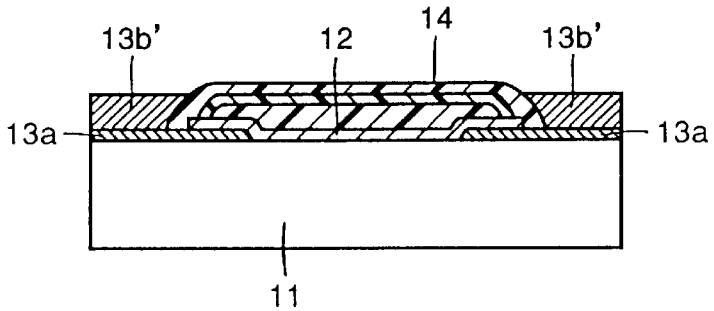
FIG. 21 is a cross section taken along the line 21-21' of FIG. 20.
Figure 22:
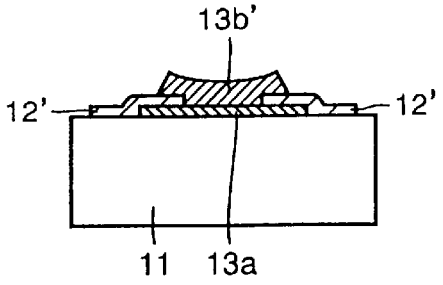
FIG. 22 is a cross section taken along the line 22-22' of FIG. 20.

More specifically, when auxiliary upper electrode 13*b* is formed on the upper surface of main upper electrode 13*a*, auxiliary upper electrode 13*b'* is formed only at a portion between extensions 12' or enclaves 12" on the upper surface of main upper electrode 13*a* as shown in FIGS. 20 to 22.

The auxiliary upper electrode 13*b'* may be formed by application of the raw material conductive paste by screen printing and sintering as described above. Alternatively, it may be formed simultaneously with formation of side electrodes 13*c* on both end surfaces of insulating substrate 11. More specifically, when the raw material conductive paste for the side electrodes 13*c* is applied to left and right end surfaces of insulating substrate 11, part of the raw material conductive paste may be heaped up to the upper surface side of main upper electrode 13*a* for forming the auxiliary upper electrode.

Figure 23:
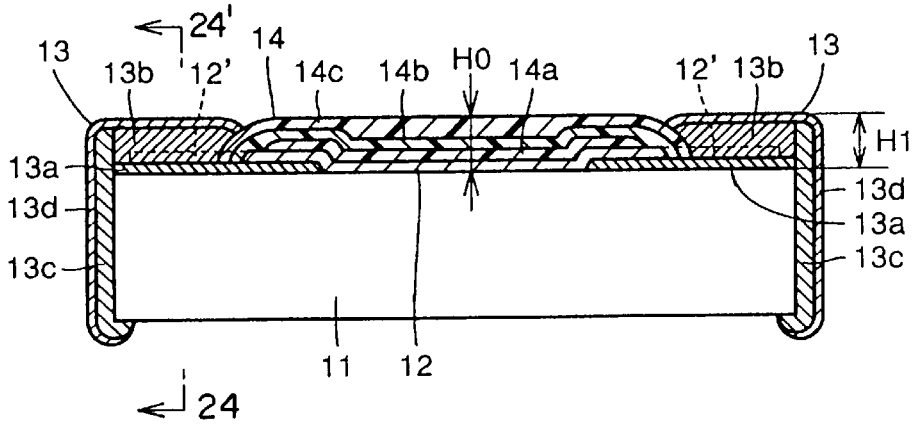
FIG. 23 is a vertical cross section showing the chip type resistor in accordance with the second embodiment.
Figure 24:
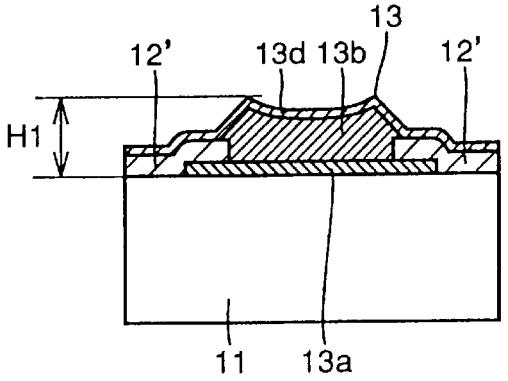
FIG. 24 is a cross section taken along the line 24-24' of FIG. 23.

Thereafter, referring to FIGS. 23 and 24, side electrodes 13*c* are formed in the similar manner on both left and right end surfaces of insulating substrate 11, metal plating is performed entirely, and a metal plate layer 13*d* is formed on surfaces of auxiliary upper electrodes 13*b* and side electrodes 13*c*. Thus terminal electrodes 13 are completed.

Chip type resistor manufactured in this manner has extensions 12' or enclaves 12" of resistive film 12 formed on both left and right sides of main upper electrodes 13*a* of terminal electrodes 13 as shown in FIGS. 23 and 24. Auxiliary upper electrode 13*b* is formed at a portion between extensions 12' or enclaves 12" on the upper surface of main upper electrode 13*a*. When auxiliary upper electrode 13*b*' is formed by applying a raw material conductive paste by screen printing or the like, the extensions or enclaves position on left and right sides function as a dam for preventing flow of the conductive paste applied to the portion therebetween in the widthwise direction of the insulating substrate. Therefore, the conductive paste in small amount can be heaped up high.

Figure 25:
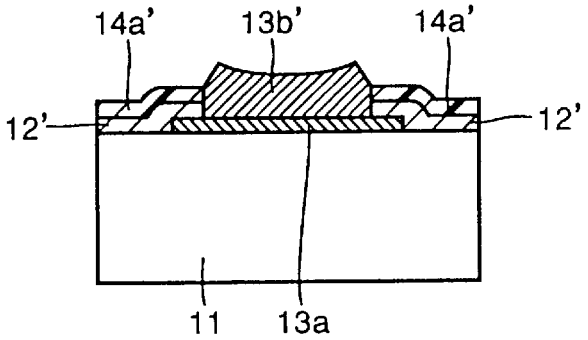
FIG. 25 is a cross section showing the same portion as that shown in FIG. 20, showing a modification of the second embodiment.
Figure 26:
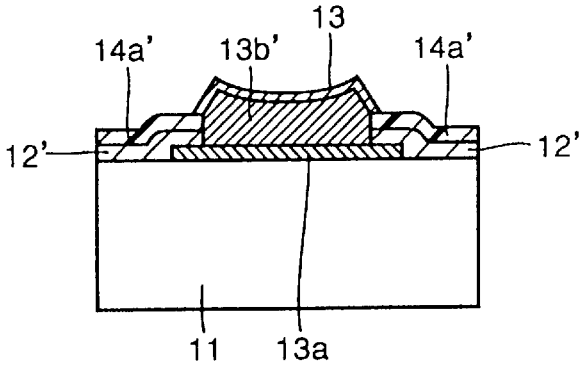
FIG. 26 is a cross section showing the same portion as that shown in FIG. 22 showing another modification of the second embodiment.

In the second embodiment, extensions 14*a*' (or enclaves) of undercoat 14*a* may be formed on the upper surface of extension 12' or enclaves 12" of resistive film 12 as shown in FIG. 25, whereby the height from the upper surface of main upper electrode 13*a* can be increased. As a result, when auxiliary upper electrodes 13*b* are formed, the effect that a small amount of conductive paste can be heaped up high is further enhanced. Further, extensions 12' or enclaves 12" of resistive film 12 can be covered by the extensions 14*a*' (or enclaves) of undercoat 14*a*. Therefore, at the time of metal plating, metal plating layer 13*c* can be formed only on auxiliary upper electrodes 13*b* as shown in FIG. 26. Further, formation of metal plate layer 13*c* on surfaces of extensions 12' or enclaves 12" of resistive film 12 can be avoided.

Here, on the upper surface of extensions 12' or enclaves 12" of resistive film 12, extensions (enclaves) of middle coat 14*b* or extensions (or enclaves) or overcoat 14*c* may be formed, in place of extensions 14*a*' (or enclaves) of undercoat 14*a*, as described above. Further, extensions (or enclaves) of at least two of undercoat 14*a*, middle coat 14*b* and overcoat 14*c* may be formed. Further, in the second embodiment, main upper electrodes 13*a* are formed, thereafter resistive film 12 is formed with extensions 12' or enclaves 12" superposed on both left and right sides of main upper electrodes 13*a*, and thereafter auxiliary upper electrodes 13*b* are formed on the upper surface of main upper electrodes 13*a* superposed between extension 12' or enclaves 12" of the resistive film 12. Alternatively, as in the example shown in FIGS. 18 and 19, resistive film 12 together with extensions 12' or enclaves 12" may be formed first, main upper electrodes 13*a* may be formed with left and right sides superposed on extensions 12' or enclaves 12" of resistive film 12, and thereafter auxiliary upper electrodes 13*b* may be formed superposed on the upper surface of the main upper electrodes 13*a* superposed on extensions 12' or enclaves 12" of the resistive film 12.

Figure 27:
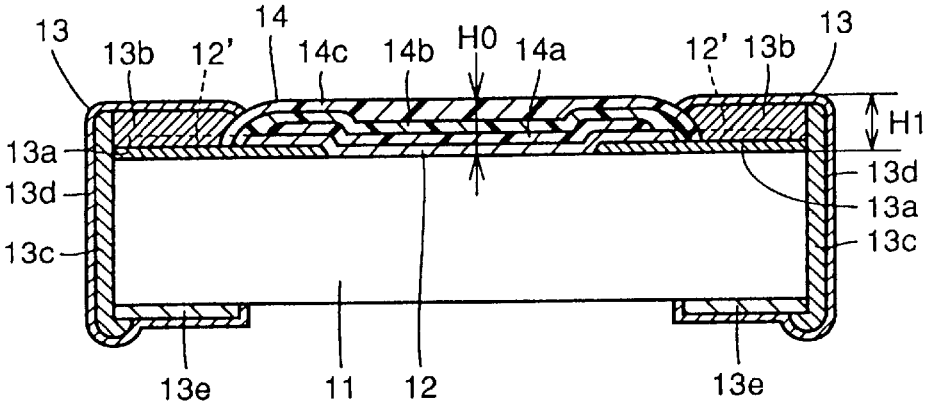
FIG. 27 is a vertical cross section showing the chip type resistor in accordance with a further embodiment.
Figure 28:
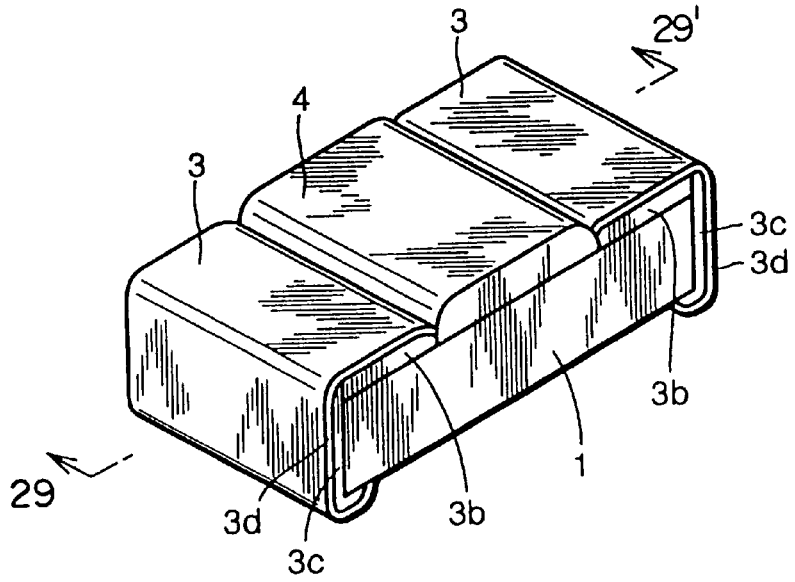
FIG.28 PRIOR ART
FIG. 28 is a perspective view showing a conventional chip type resistor.
Figure 29:
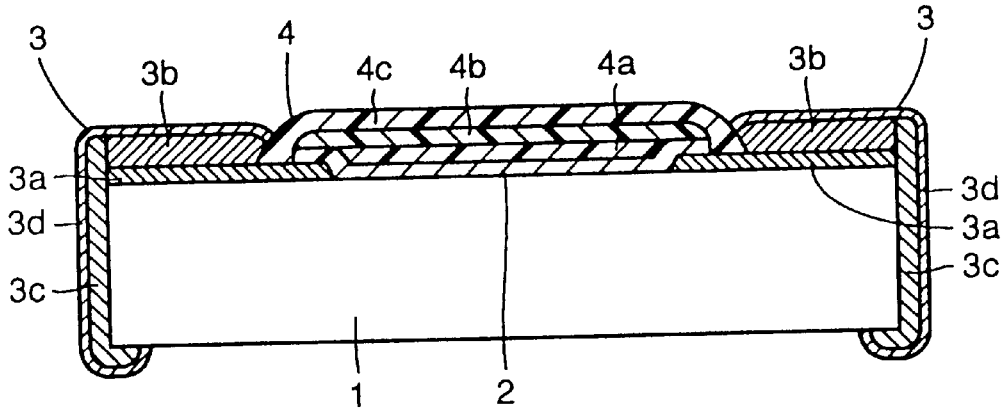
FIG.29 PRIOR ART
FIG. 29 is a cross section taken along the line 29-29' of FIG. 28.

Further, in each of the embodiment described above, a lower electrode 13*e* constituting part of terminal electrode 13 may be formed on a lower surface of insulating substrate 11 as shown in FIG. 27, whereby it becomes possible to mount the chip on a printed board with the side of resistive film 12 facing upward.

Generally, lower electrode 13*c* is formed by screen printing and sintering of a raw material paste in a process step before forming main upper electrodes 13*a* or resistive film 12. However, it is possible to form lower electrode 13*e* simultaneously with formation of side electrodes 13*c* on both end surfaces of insulating substrate 11. More specifically, the lower electrode may be formed, when a raw material conductive paste for side electrodes 13*c* are applied to left and right end surfaces of insulating substrate 11, by heaping up part of the raw material conductive paste on the lower surface of insulating substrate 11.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A chip type resistor comprising:

an insulating substrate;

a pair of left and right main upper electrodes formed on an upper surface of said insulating substrate;

a resistive film formed on the upper surface of the insulating substrate between said left and right main upper electrodes, said resistive film formed with extensions or enclaves overlapping opposite side edges of an upper surface of each said main upper electrode;

auxiliary upper electrodes formed on upper surfaces of the extensions or enclaves and on the upper surface of said main upper electrodes; and a cover coat covering the resistive film.

2. The chip type resistor according to claim 1, wherein said auxiliary upper electrodes are formed on the upper surface of said main upper electrodes between the extensions or enclaves of the resistive film.

3. The chip type resistor according to claim 1, wherein said main upper electrodes are formed such that left and right side edges are superposed on the extensions or enclaves of said resistive film, and said auxiliary upper electrodes are formed on the upper surface of the main upper electrodes superposed on the extensions or enclaves of said resistive film.

4. The chip type resistor according to claim 1, wherein said main upper electrodes are formed such that left and right side edges are superposed on the extensions or enclaves of said resistive film, and said auxiliary upper electrodes are formed on the upper surface of the main upper electrodes between portions superposed on the extensions or enclaves of said resistive film.

* * * * *

UNITED STATES PATENT AND TRADEMARK OFFICE

CERTIFICATE OF CORRECTION

PATENT NO. : 5,990,781

DATED : November 23, 1999

INVENTOR(S) : Kambara

It is certified that error appears in the above-identified patent and that said Letters Patent is hereby corrected as shown below:

Title page, item [54] and col. 1, delete "CHIP TYPE RESISTOR AND MANUFACTURING METHOD THEREOF", and insert-- CHIP TYPE RESISTOR--

Signed and Sealed this

Sixteenth Day of January, 2001

*Attest:*

*Attesting Officer*

Q. TODD DICKINSON

*Commissioner of Patents and Trademarks*